United States Patent [19]

Andersson et al.

[11] Patent Number: 4,818,497

[45] Date of Patent: Apr. 4, 1989

[54] DEVICE FOR PURIFICATION OF EXHAUST GASES

[75] Inventors: Lars Andersson; Berndt Stenlund, both of Sandviken; Rolf Wiberg, Gävle, all of Sweden

[73] Assignees: Sandvik AB, Sandviken; PIO AB, Ockelbo, both of Sweden

[21] Appl. No.: 61,779

[22] Filed: Jun. 15, 1987

[30] Foreign Application Priority Data

Jun. 16, 1986 [SE] Sweden ..... 8602670

[51] Int. Cl.[4] ..... F01N 3/15

[52] U.S. Cl. ..... 422/179; 422/180; 422/221; 55/509; 55/511; 55/513; 55/DIG. 30

[58] Field of Search ..... 422/179, 180, 221; 55/509, 511, 513, DIG. 30

[56] References Cited

U.S. PATENT DOCUMENTS

| | | | |
|---|---|---|---|
| 3,963,445 | 6/1976 | Koyama et al. | 422/179 |
| 4,278,639 | 7/1981 | Tadokoro et al. | 422/179 X |
| 4,278,717 | 7/1981 | Aoyama | 422/179 X |
| 4,335,078 | 6/1982 | Ushijima et al. | 422/180 X |
| 4,353,872 | 10/1982 | Midorikawa | 422/180 X |
| 4,397,817 | 8/1983 | Otari et al. | 422/179 |
| 4,448,754 | 5/1984 | Tsogai et al. | 422/179 |
| 4,556,543 | 12/1985 | Mochida et al. | 422/180 X |
| 4,581,206 | 4/1986 | Otani et al. | 422/221 X |
| 4,629,605 | 12/1986 | Santiago | 422/179 |
| 4,662,911 | 5/1987 | Hirayama et al. | 422/180 X |
| 4,698,213 | 10/1987 | Shimozi et al. | 422/179 |

FOREIGN PATENT DOCUMENTS

| | | |
|---|---|---|
| 2245535 | 4/1974 | Fed. Rep. of Germany . |
| 73120339 | 9/1973 | Sweden . |
| 74009739 | 1/1974 | Sweden . |
| 74010513 | 1/1974 | Sweden . |
| 0431894 | 3/1984 | Sweden . |
| 0443187 | 2/1986 | Sweden . |

*Primary Examiner*—Barry S. Richman
*Assistant Examiner*—Lynn M. Kummert
*Attorney, Agent, or Firm*—Burns, Doane, Swecker & Mathis

[57] ABSTRACT

An exhaust gas purifier of the type wherein a catalytic body is elastically supported within a metal casing. This is achieved by at least partly filling a space between the catalytic body and the metal casing with a dampening member comprising one or more wire blocks. The wire is preformed of a screw shape and that preformed wire is wound into the shape of the block. This block is stretched to elastically fit over the body, and the block is compressed between the body and the casing.

9 Claims, 4 Drawing Sheets

DEVICE FOR PURIFICATION OF EXHAUST GASES

BACKGROUND OF THE INVENTION

The present invention relates to a device for purification of gases especially exhaust gases from combustion engines comprising a catalytic converter having the shape of a body of ceramic or metallic material which is enclosed by a metal casing. A space formed between the body and the metal casing is at least partly filled with a dampening member of wire.

It is known to use a ceramic body for purification of exhaust gases which functions as a catalytic converter for detoxification of exhaust gases from combustion engines, especially in motor vehicles. One of the problems with hitherto tested devices has been to create a well adapted bearing for the ceramic body relative to the surrounding metal casing. The body has a relatively small mechanical strength due to its ceramic character. Therefore it is principally impossible to directly hold the ceramic body within a rigid metal construction.

Tests, for example, to embed the ceramic body with an intermediate layer of heat resistant ceramic fibers or with an intermediate wire-mesh have not produced satisfactory results. Tests have also been made to elastically embed the carrier by means of resilient metal bellows supporting against the metal casing as described in the German published patent application No. 2,245,535. Such a construction, however, brings complications during assembling and brings complications relating to fitting accuracy.

The problem which the present invention aims to solve is to create an exhaust gas purifier of the above-mentioned type wherein the catalytic body may be elastically beared within the metal casing in a simple manner while having a sufficiently safe resistance within the working range of the combustion engine.

The solution of the task according to the invention is that the space between the metal csing and the body is at least partially filled with pretensioned blocks of wire wherein the wire has a polygonal cross-section. In a preferred embodiment of the invention the wire consists of flat rolled wire having a rectangular cross-section and being of a heat resistant high-alloy steel.

The drawings

A preferred embodiment of the invention will be more clearly described hereinafter in connection with the appended drawings wherein.

DESCRIPTION OF A PREFERRED EMBODIMENT OF THE INVENTION

Figure 1:
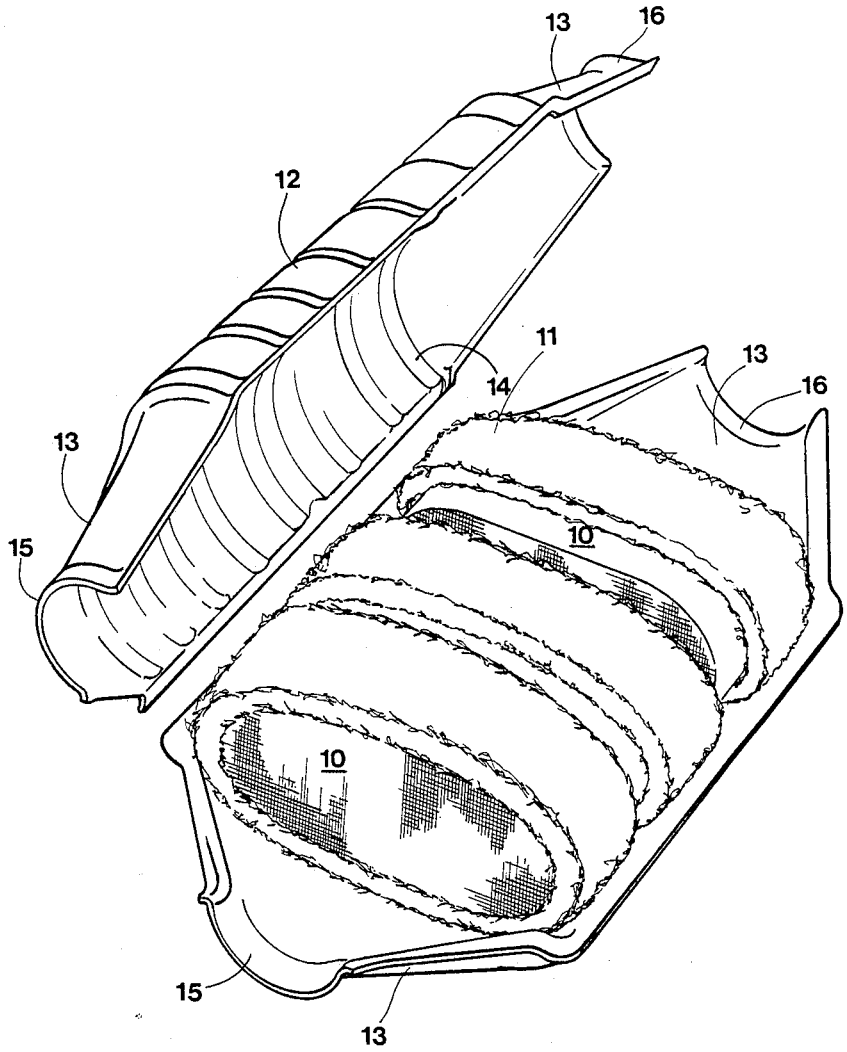
FIG. 1 shows a perspective view of a catalytic converter.

The embodiment shown in FIG. 1 comprises two ceramic monolithic catalytic bodies 10 having conventional honeycomb structure which can keep their shape and strength at high temperatures, up to 1150° C. for example. Alternatively the bodies 10 may be metallic.

Figure 4:
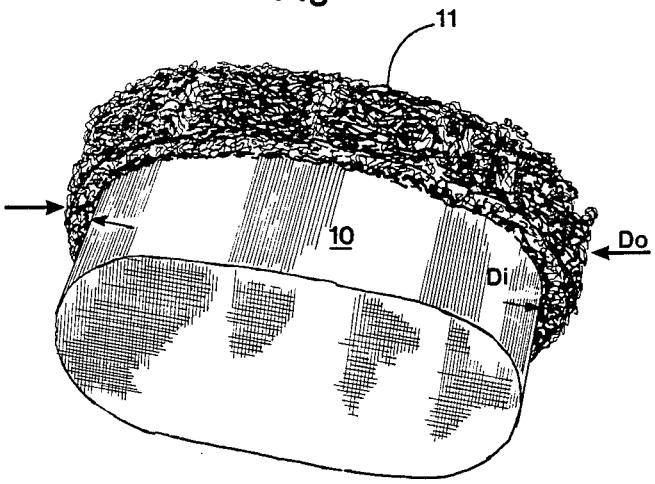
FIG. 4 shows a perspective view of a ceramic body and an expanded dampening member.
Figure 5:
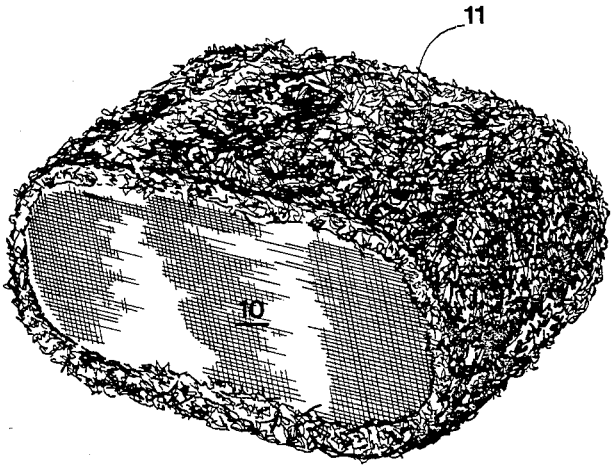
FIG. 5 shows a perspective view of a ceramic body and an alternative dampening member.

Each catalytic body 10 is provided with blocks 11 of spirally wound wire of a heat resistant high-alloy steel. Alternatively the whole envelope surface of the catalytic body 10 may be completely covered by one or more of such blocks 11 (FIG. 4). The catalytic body 10 is beared within a metal cover comprising a casing 12 or metal and two cone-shaped end pieces 13 of the same material for attachment to an exhaust gas device (not shown). The body 10 has a mainly oval section in the shown embodiment and the surrounding casing 12 is adapted to the shape of the catalytic bodies. In order to bear the blocks 11 safely in the axial direction of the body 10, ridges 14 in the cover are preferably adapted at each end of each catalytic body. The casing forms an inner chamber having an exhaust gas inlet port 15 arranged at one end and the other end is provided with an exhaust gas outlet port 16 of the same material. The above-mentioned cone-shaped end pieces 13 connect the inlet port 15 and the outlet port 16 with the metal casing 12 surrounding the catalytic body.

The cover which is formed by the casing 12, the cone ends 13 and the inlet and outlet ports 15, 16 is preferably made in two parts.

Figure 3A:
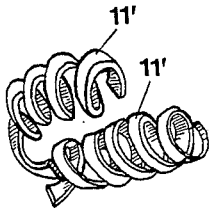
FIG. 3A shows a portion of the dampening member of FIG. 3.
Figure 3:
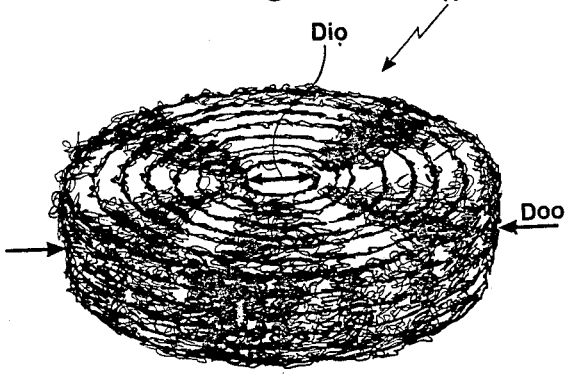
FIG. 3 shows a relaxed dampening member in a perspective view.

The space occurring between the body 10 and the casing 12 is partly or completely filled with wire blocks 11 of flat rolled wire which are applied around the body 10 under pretension and which function as a dampening member. FIG. 3 shows a dampening member 11 which has a basic shape of a cylindrical block and consists of windings of wires 11, which are of a preformed screw shape (FIG. 3A), the wire, having a mainly rectangular cross-section. The wire 11' consists of heat and acid resistant, alloyed steel or austenitic or ferritic steel. The wire is bent in screw-shape around its longitudnal axis. The block 11 is produced by the preformed screw-shaped wire 11' being wound around a narrow journal whereby the outer $D_{oo}$ diameter of the outer periphery of the block successively increases. The diameter of the journal defines the inner diameter $D_{io}$ of the inner periphery of the block. Each block preferably consists of two screw-shaped wires, as seen in FIG. 3A. The wire has a thickness which does not exceed 0.22 mm, preferably it is between 30 and 100 mm. The wire has 10 to 20 loops, preferably about 15 loops, per centimeter of curled wire. One centimeter of curled wire comprises about 10 centimeters of wire.

The block 11 has an original inner diameter $D_{io}$ of about 40 mm (i.e., smaller than the body cross-section) and an original outer diameter $D_{oo}$ of about 80 mm when the block is in a relaxed state. When the block 11 is to be mounted to the ceramic body 10, it is simply elastically expanded, pushed over the body and released to exert inward gripping forces against the body, FIG. 4. The inner measure $D_i$ of the block is therewith adapted to the dimension of the body, regardless of the shape of the body. In case of a cylindrical body, which has a diameter of 400 mm the original diameter $D_{io}$ of the block changes from 40 mm to 400 mm and the original outer diameter $D_{oo}$ changes from 80 mm to 410 mm. Thus the inner diameter expands about double the expansion of the outer diameter during mounting, expressed as a percentage. The expanded block will thus exert a force towards the center of the ceramic body or towards the curvature centers of non-cylindrical bodies.

Preferably the axially outer parts of the block are folded over the edge 10A of the ceramic body so as to bear against the ridges 14 thereby preventing contact between the ridges and the bodies 10.

The assembling of the purifier is done as follows. The ceramic bodies 10 enclosed by the blocks 11 are put into place in the lower half of the cover. Then the upper half of the cover, which is mainly identical in shape with the lower half, is forced over the blocks 11 and bodies 10. When flanges of the upper are welded together. The blocks 11 will thus be compressed by the cover, i.e., the measure $D_o$ will be reduced thus creating a force acting upon the bodies and the cover. In this position the blocks will endeavor to expand along with the cover partly because they are prestressed or pretensioned and partly because of heat expansion during the work of the combustion engine.

Figure 2:
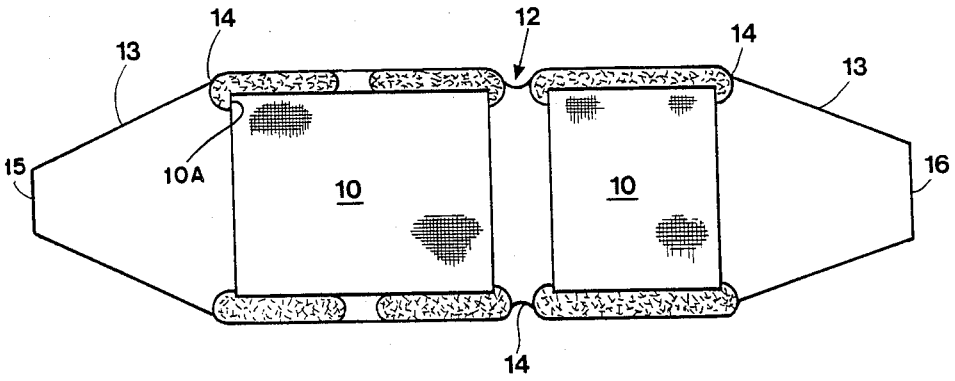
FIG. 2 shows a longitudinal section of the catalytic converter of FIG. 1.

In the preferred embodiment of the present invention as shown in FIGS. 1 and 2 the cover surrounds two ceramic bodies of different sizes wherein the larger body is closest to the inlet port 15 and the smaller body is closest to the outlet port 16. The larger body is surrounded by two blocks and the smaller body is surrounded by one block. The number of bodies and blocks may vary dependent of the size of the casing.

Figure 6:
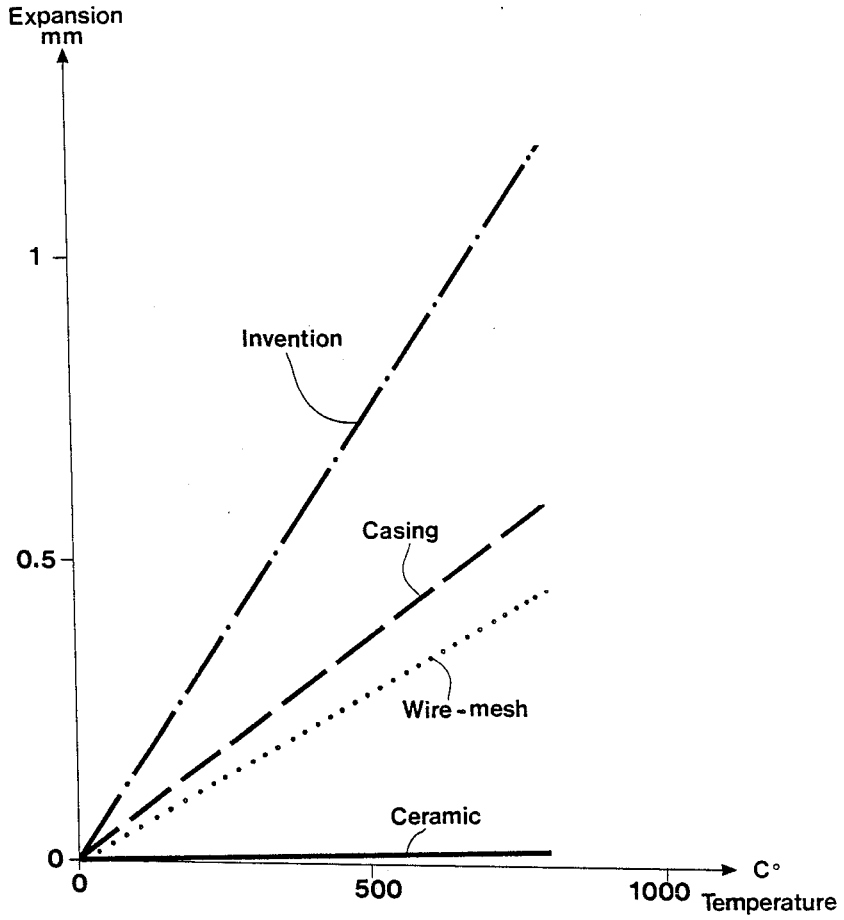
FIG. 6 shows a temperature and heat expansion diagram.

FIG. 6 shows a temperature and heat expansion diagram for the ceramic body 10, the prior art wire mesh, the casing 12 and the block 11 according to the invention. At 800° C. the expansion for the ceramic body is practically zero mm. The heat expansion for the casing is about 0.6 mm at that temperature. This causes an additional space between the body and the casing which is about 0.6 mm. Since wire-mesh at that temperature expands to only about 0.45 mm there will be unfilled play of about 0.15 mm between the casing and the wire-mesh such that the ceramic body may vibrate within the casing. The invention will keep its elastic properties throughout the lifetime of the converter, while existing solutions are more prone to losing their elasticity. The block according to the invention wants to expand to 800° C. to 1.2 mm, i.e., double the space created between the casing and the ceramic body. Thus no vibrational damages on the ceramic body can occur when the block is used.

A safe elastical bearing of the catalytic body is thereby created. It has been proved essential that the wire in the block 11 is flat rolled into a polygonal cross-section, preferably rectangular. Variations lengthwise due to heat of the surrounding casing 12 and the ceramic body 10 and the forces caused by said variation thus may be received in an effective manner. Tests with the bearing proposed by the present invention have shown that the ceramic body and the surrounding casing become effectively protected from premature destruction under the effects of the exhaust gases and the mechanical strain. A four-season test has shown that said bearing remains unaltered after at least 1400 hours of work with a normal combustion engine and otherwise normal vibrational strains. The loosening up of the joint between metal and ceramics apprehended in other constructions cannot occur, which means that the cross-section of the ceramic body 10 nd the metal casing 12 may be arbitrarily chosen. At the above-mentioned 1400 hours test it has been established that the pre-tensioning of the elastical wire block around the catalytic body has ben maintained to a sufficiently high degree within both the lower and upper power range of the combustion engine.

We claim:

1. Apparatus for the catalytic purification of exhaust gases from combustion engines, comprising an elongated casing forming a chamber with an exhaust gas inlet port at one end thereof and an exhaust gas outlet port at another end thereof, a catalytic body disposed in said chamber, dampening means disposed in said chamber and comprising at least one block formed of a wire and fitted around an outer surface of said catalytic body, said wire being of a preformed screw shape, said preformed screw-shaped wire being wound into the shape of said at least one block such that said at least one block defines inner and outer peripheries, said screw-shaped wire providing said at least one block with elasticity enabling said at least one block to be elastically expanded and compressed, said inner periphery of said at least one block being of smaller cross-section than said catalytic body when said at least one block is in a relaxed state, said at least one block being elastically expanded so that said inner periphery is stretched around said outer surface of said catalytic body and exerts inward gripping forces thereagainst, said at least one block being disposed in an annular space defined between said catalytic body and said elongated casing and elastically compressed therebetween whereby the inward gripping forces are enhanced and said outer periphery is outwardly biased against an inner surface of said casing to enable said at least one block to expand outwardly within said annular space as said space enlarges in response to thermal expansion of said casing.

2. Apparatus according to claim 1, wherein said annular space between said catalytic body and said casing is completely filled by said dampening means.

3. Apparatus according to claim 1, wherein said annular space between said catalytic body and said casing is partly filled by said dampening means which comprises at least two said blocks separated from each other and distributed over an outer surface of said catalytic body.

4. Apparatus according to claim 1, wherein said wire is preformed with about 10 to 20 loops per centimeter defining said screw-shaped, and one length unit of preformed screw-shaped wire comprises about ten unit lengths of straight wire.

5. Apparatus according to claim 1, wherein axially outer parts of said dampening means are folded over an edge of said catalytic body.

6. Apparatus according to claim 1, wherein said casing comprises two identical halves secured together, said halves surrounding two of said catalytic bodies formed of ceramic, said two bodies being of different sizes wherein a larger body thereof is closest to said inlet port and a smaller body thereof is closest to said outlet port, said larger body being surrounded by two of said blocks and said smaller body being surrounded by one block.

7. Apparatus according to claim 1, wherein the material of construction of said dampening means is selected to have a thermal expansion coefficient greater than that of said casing and greater than that of said catalytic body.

8. Apparatus according to claim 1, wherein said wire is flat rolled and comprises high alloy steel and has a rectangular cross-section.

9. Apparatus according to claim 8, wherein said annular space between said catalytic body and said casing is completely filled by said dampening means.

* * * * *